United States Patent [19]

Trusty

[11] Patent Number: 4,790,435

[45] Date of Patent: Dec. 13, 1988

[54] CARD DISPENSER

[75] Inventor: Robert D. Trusty, Mitchell, S. Dak.

[73] Assignee: Cardmatic, Inc., Sioux Falls, S. Dak.

[21] Appl. No.: 111,511

[22] Filed: Oct. 20, 1987

[51] Int. Cl.[4] ..... B65D 85/67

[52] U.S. Cl. ..... 206/39.5; 206/39; 224/195

[58] Field of Search ..... 206/39, 39.3, 39.4–39.6, 206/39.8, 556, 357; 40/10 R, 16, 17, 19; 224/195, 196, 253

[56] References Cited

U.S. PATENT DOCUMENTS

| | | | |
|---|---|---|---|
| 231,863 | 8/1880 | Stratton | 206/39.5 |
| 383,036 | 5/1888 | Breese | 206/39.5 |
| 798,261 | 8/1905 | Brown | 206/39 |
| 1,062,174 | 5/1913 | Long | 206/39.5 |
| 1,126,139 | 1/1915 | Walker | 206/39.5 |
| 1,155,737 | 10/1915 | Kinzie | 206/39.5 |
| 1,217,177 | 2/1917 | Homyer, Jr. | 206/39.5 |
| 1,535,997 | 4/1925 | Halansky | 206/39.5 |
| 1,537,244 | 5/1925 | McCaghren | 206/39.5 |
| 2,776,743 | 1/1957 | Treiss | 206/357 |
| 3,286,823 | 11/1966 | Gillespie | 206/39.5 |

*Primary Examiner*—Jimmy G. Foster

*Attorney, Agent, or Firm*—Aisenberg & Platt Berman

[57] ABSTRACT

A cardholder for containing and dispensing business cards has a housing containing a flat spring, a cover plate for the spring for supporting the cards, and a backing plate. The cover plate, spring and backing plate are fitted into the housing, and the cards are inserted into the housing on top of the cover plate. The cards may be dispensed singly by pressure through a window opening in the housing.

13 Claims, 1 Drawing Sheet

CARD DISPENSER

FIELD OF THE INVENTION

The invention relates to dispensing of business cards or the like from a card dispensing holder or belt buckle card dispensing holder.

BACKGROUND OF THE INVENTION

Known card holders for dispensing business cards or the like, which include springs, are generally bulky and/or heavy. The patent to Morales, U.S. Pat. No. 3,710,929, describes a card dispenser which is designed for standing on a desk or putting in the user's pocket. The Morales device uses a pair of coiled springs which do not provide reliably even support, and which necessitate that the device has substantially greater depth than the inventive device.

SUMMARY OF THE INVENTION

The automatic card dispenser of the invention has four parts: a front cover, forming a housing for the device, having an open window and three retaining flanges to support the cards, a back plate of slightly smaller size than the front cover which slides into the front cover and locks by means of two locking dimples, a flat spring, and a cover plate having a flange engaged with the flat spring.

An object of the invention is to provide a dispenser for business cards or the like.

Another object of the invention is to provide a card holder in the form of a belt buckle.

DETAILED DESCRIPTION OF THE INVENTION

The card holder of the invention holds business cards for convenient single card dispensing. The card holder has only four parts, a front cover, a back cover, a cover plate, and a flat spring.

Figure 1:
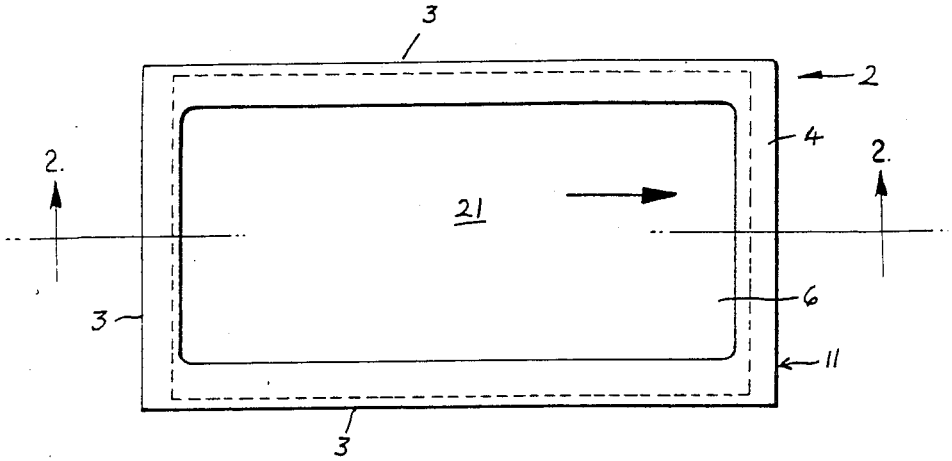
FIG. 1 is a top view of a card holder of the invention.
Figure 2:
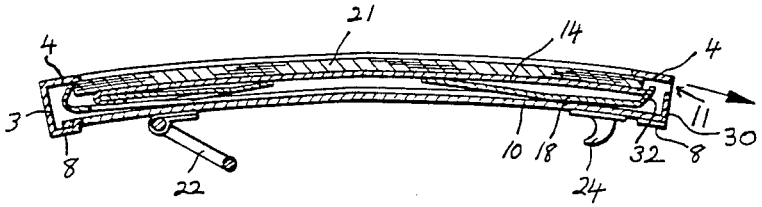
FIG. 2 is a cross-sectional view taken on line 2—2 of FIG. 1, the card holder being adapted for use as a belt buckle.
Figure 3:
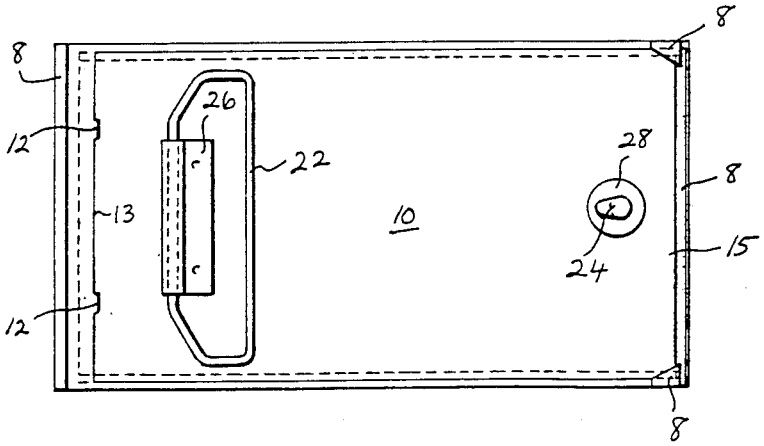
FIG. 3 is a bottom view of the card holder of FIG. 2.
Figure 4:
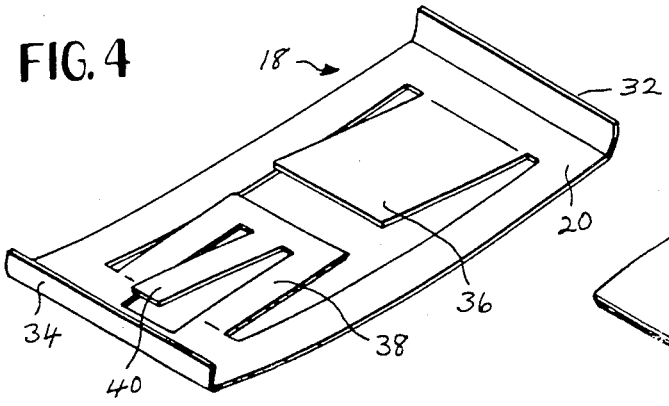
FIG. 4 is a perspective view of a spring member of the invention.
Figure 5:
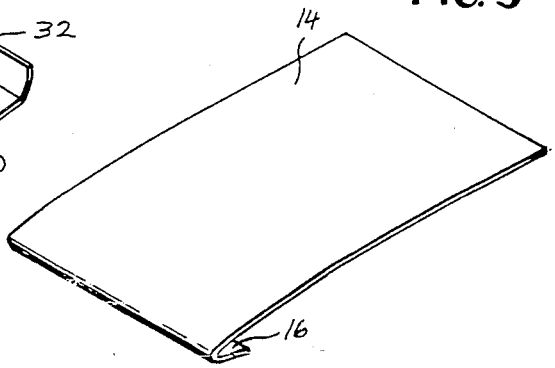
FIG. 5 is a perspective view of the cover plate.

With reference to FIGS. 1 to 5, in which like numbers represent like parts, front cover 2 has upstanding sides 3 on three sides, and a rectangular top surface 4 having an open window 6 through which a card placed in the holder may be viewed. The fourth side of front cover 2 is open, at aperture 11, for insertion of the other members (back cover, flat spring and cover plate) of the device. Retaining flanges 8 on the base of front cover 2, provide even support for the members inserted into the card dispensing device.

A back cover 10 having a slightly smaller size than the perimeter of the front cover slides into an aperture 11 in one end of the front cover and locks by means of locking dimples 12 at end 13 of back cover 10 which engage with portions of front cover 2. The locking dimples or other locking device may be located at any convenient position on the back cover and/or front cover. Flange 30 extends upwardly from other end 15 of back cover 10 and partially closes aperture 11. A flat or slightly arcuate cover plate 14 having a lip 16 extending downwardly at one end engages with flat spring 18, and cover plate 14 and flat spring 18 are inserted into front cover 2 together with back cover 10.

Flat spring 18 is inserted into front cover 2 so that retaining flange 32, upstanding from one end of flat spring 18, is positioned at the dispensing end of the cardholder and flange 34, upstanding from the other end of flat spring 18, is positioned at the closed end of front cover 2. Flat spring 18 is configured having spring portions 36 and 38 extending upwardly at an angle from opposite ends of central, slightly arcuate, flat spring portion 20. Spring portion 40 is cut from spring portion 38 and extends upwardly for resiliently supporting cover plate 14. Flat spring 18 is cut from a single piece of springy material, for example, brass or stainless steel, or other material known to one skilled in the art. The spring is cut from a rectangular blank, flanges 32 and 34 are turned upward, and spring portions 36, 38 and 40 are elevated from base portion 20, to be positioned for resiliently supporting the card-carrying cover plate 14. Base portion 20 may be slightly arcuate from end to end. Other springy metals or plastic may be used, as long as the integrity of the spring system is maintained.

In use, flat spring 18 and cover plate 14 are assembled together with back cover 10 and the assembly of these three parts if fitted slidingly through aperture 11 into front cover 2. The business cards are slipped through aperture 11 in front cover 2 to rest on cover plate 14 for viewing through window 6, and may be dispensed singly through aperture 11, by pressure on the top card through window 6 in the direction of the arrow shown in FIGS. 1 and 2.

Back cover 10 may either be a substantially flat plate or a slightly arcuate plate if the card dispenser is to be kept, for example, in a desk, drawer or pocket, or adapted for use as a belt buckle by means of belt loop 22 and pin 24 attached to back plate 10. Belt loop 22 may be attached to back plate 10 by means of plate 26. Pin 24 may be attached to back plate 10 by means of plate 28. Business cards 21 are inserted through aperture 11 and dispensed singly from aperture 11.

A balanced single flat spring 18 regulates the pressure on cover plate 14 for dispensing, and is self-adjusting according to the number of business cards in the holder. Flat spring 18 allows cards 21 to be dispensed singly. By applying light pressure to business cards 21, held on top of cover plate 14 and under front housing 4, flat spring 18 is slightly depressed allowing retaining flange 32 to be slightly depressed, and thus allowing a business card 21 to be released by sliding it from under front cover 2. This is a single step pressure motion to release a card.

In a typical non-limiting example, flat spring 18 is made from a flat brass sheet 0.010 inches in thickness, 3.87 inches long, and 2.0 inches wide. Spring portions 36 and 38, each 1.06 inches wide are cut in the blank, and spring portion 40 is cut from spring portion 38. Spring portion 40 is, for example, 0.34 inches wide. Variations on these exemplary dimensions will be apparent to one skilled in the art.

By modifying back cover plate 10, the card dispenser may either have a flat back cover plate suitable for placing on a desk or in a pocket, or may have an added loop 22 attached to back plate 10 by plate 26 and added pin 24 attached to back plate 10 by plate 28, allowing the card dispenser to function as a belt buckle. The card dispenser may, alternatively, include a clip attachment, enabling it to be fastened to a suit, purse, pocket, etc. Thus, the business card has constant exposure to the public. The cardholder of the invention provides easy access, constant supply, convenience, attractiveness, and a unique professional and business image.

The balanced single flat spring with retaining flange 32, will also accept and dispense other materials similar in stock weight to business cards, for example, metal cards or plastic cards. The dispenser may be manufactured out of a variety of materials, such as metals and plastics, as long as the integrity of the spring system is maintained for dispensing single cards.

While the invention has been described above with respect to certain embodiments thereof, it will be appreciated that variations and modifications may be made without departing from the spirit and scope of the invention.

What is claimed is:

1. A cardholder for containing a plurality of business cards or the like, comprising:

covering means for supporting business cards, flat spring means for supporting the covering means, said flat spring meas comprising a flat spring having upturned flange portions for retaining the covering means in position;

backing means for supporting the spring means; and housing means for supporting the backing means, spring means and covering means;

wherein the backing means, spring means and covering means are engaged in the housing means, and business cards are dispensed through an opening between the housing means and a flange on the backing means.

2. A cardholder of claim 1 wherein the flat spring means further comprises at least one spring portion extending upwardly for supporting the covering means.

3. A cardholder of claim 2 wherein the flat spring means comprises two spring portions for supporting the covering means.

4. A cardholder of claim 2 wherein the flat spring means comprises three spring portions for supporting the covering means.

5. A cardholder of claim 1 wherein the covering means comprises flange means for engaging with the spring means.

6. A cardholder of claim 1 wherein the backing means comprises means for attaching to a belt.

7. A cardholder of claim 1 wherein the backing means, spring means and covering means are slidingly engaged in the housing means.

8. A cardholder of claim 1 wherein business cards are dispensed singly through the opening.

9. A cardholder comprising:

a housing having a window opening for displaying a card, a backing plate supported by flanges extending from the housing and spaced from the window opening, said backing plate comprising a flange at one end cooperating with said housing to form a slot, a flat spring supported by the backing plate and comprising oppositely extending flat spring portions and a flange extending upwardly from each end of the flat spring, and a cover plate mounted on the flat spring in contact with at least one of said flat spring portions and portioned between the upwardly extending flanges, wherein a business card may be carried by the cover plate aligned with said window opening and said slot to permit the user to contact the card through the window opening and dispense the card through the slot.

10. A cardholder of claim 9 wherein the cover plate comprises a flange extending along one end thereof for engaging with the flat spring.

11. A cardholder of claim 9 wherein the flat spring further comprises a spring portion extending upwardly from at least one of said oppositely extending flat spring portions.

12. A cardholder of claim 11 wherein the cover plate is in contact with said spring portion.

13. A cardholder of claim 9 further comprising locking means for engaging said backing plate with said housing.

* * * * *